US009103221B2

(12) United States Patent
Torkaman et al.

(10) Patent No.: US 9,103,221 B2
(45) Date of Patent: Aug. 11, 2015

(54) SYSTEM AND METHOD FOR BLADE RETENTION

(75) Inventors: Alex Torkaman, Port St. Lucie, FL (US); Kevin Carpenter, Palm Beach Gardens, FL (US); William David Day, Jupiter, FL (US)

(73) Assignee: ALSTOM TECHNOLOGY LTD, Baden (CH)

( * ) Notice: Subject to any disclaimer, the term of this patent is extended or adjusted under 35 U.S.C. 154(b) by 802 days.

(21) Appl. No.: 13/398,241

(22) Filed: Feb. 16, 2012

(65) Prior Publication Data

US 2013/0216387 A1 Aug. 22, 2013

(51) Int. Cl.
*F01D 5/32* (2006.01)

(52) U.S. Cl.
CPC ..... *F01D 5/323* (2013.01); *Y10T 29/49321* (2015.01)

(58) Field of Classification Search
CPC ... F05D 2260/30; F01D 5/3007; F01D 5/323; F01D 5/326; F01D 5/32
See application file for complete search history.

(56) References Cited

U.S. PATENT DOCUMENTS

| | | | | |
|---|---|---|---|---|
| 3,572,970 | A | 3/1971 | Smuland | |
| 8,894,378 | B2 * | 11/2014 | Jayana | 416/248 |
| 2012/0177498 | A1 * | 7/2012 | Yarava et al. | 416/220 R |

FOREIGN PATENT DOCUMENTS

| | | |
|---|---|---|
| DE | 1551211 | 2/1970 |

OTHER PUBLICATIONS

International Search Report and Written Opinion of Apr. 3, 2013 for PCT/US2013/026693.

* cited by examiner

*Primary Examiner* — Nathaniel Wiehe
*Assistant Examiner* — Jeffrey A Brownson
(74) *Attorney, Agent, or Firm* — Shook, Hardy & Bacon L.L.P.

(57) ABSTRACT

A system and method for securing a blade within a disk so as to eliminate the need for permanently deforming materials associated with the blade disk is disclosed. A recess is formed generally within each slot used to secure a blade within the disk. A retaining insert is positioned within the recess and a wedge insert is positioned within a slot of the retaining insert, such that a pressure is applied to the retaining insert thereby deflecting the retaining insert into a pre-set radial position to prevent axial movement of the blade within the slot of the disk.

23 Claims, 5 Drawing Sheets

SYSTEM AND METHOD FOR BLADE RETENTION

CROSS-REFERENCE TO RELATED APPLICATIONS

Not applicable.

TECHNICAL FIELD

The present invention generally relates to a rotating blade and disk of a gas turbine engine and more specifically to a system and method of securing the blade to the disk.

BACKGROUND OF THE INVENTION

Blades of a gas turbine engine have an airfoil and are held within a rotating disk by an attachment. The disk rotates at a high rate of speed or revolutions per minute in order to compress a fluid passing through, such as air. For example, an axial compressor typically comprises a plurality of stages, where each stage includes a set of stationary compressor vanes which direct a flow of air into a rotating disk of compressor blades, where each stage of the compressor decreases in diameter, causing the pressure and temperature of the air to increase.

Axial compressors having multiple stages are commonly used in gas turbine engines for increasing the pressure and temperature of air to a pre-determined level at which point a fuel can be mixed with the air and the mixture ignited. The hot combustion gases then pass through a turbine to provide either a propulsive output or mechanical output.

Despite operating in a relatively low temperature environment, compressor blades still require routine inspection and maintenance, which typically requires removal from the disk. However, prior art blade retention mechanisms, typically utilize staking or rolling of material from the disk over material of the compressor blade in order to prevent the blade from sliding within the disk slot. Staking is defined as the process of plastically deforming material using a tool similar to nail punch. While this process accomplishes the purpose of retaining the blade within the slot, in order to remove the blades, the rolled material must also be removed, leaving behind the holes and divots shown in FIGS. 2 and 3. After multiple times staking or rolling the disk material, the disk itself must be repaired or replaced. Other ways of securing blades in place include staking material of a replaceable staking insert as discussed in U.S. Published Patent Application 2009/0077795.

SUMMARY

In accordance with the present invention, there is provided a novel and improved system and method for securing a blade within a disk so as to eliminate the need for permanently deforming materials associated with the blade disk.

The present invention is directed towards a system and method for securing a compressor blade within a disk. In a first embodiment, a rotating assembly is provided comprising a disk having a plurality of slots with each slot having a retaining recess. A plurality of blades is positioned within the slots of the disk. A retaining insert is positioned within a portion of the slot and secures a blade within the slot by bending upward after assembly due to a load applied by a wedge insert, and remain locked in a pre-set radial position relative to blade root.

In an alternate embodiment of the present invention, a retaining mechanism is provided for securing a blade to a rotor disk. The retaining mechanism comprises a retaining recess positioned within the rotor disk and a retaining insert sized to fit within the recess. An angled wedge insert is positioned within a slot of the retaining insert so as to displace and secure in radial position a portion of the retaining insert.

In yet another embodiment of the present invention, a method of retaining a blade within a rotor disk is disclosed. The method comprises placing a retaining insert into a retaining recess of the rotor disk, depressing an upper portion of a retaining insert, inserting a blade into a slot of a rotor disk and placing a wedge insert into a slot of the retaining recess so as to exert a force in a radially outward direction on an upper portion of the retaining insert so as to locate the upper portion of the retaining insert in a preset radial location preventing the removal of the blade from the slot of the rotor disk.

Additional advantages and features of the present invention will be set forth in part in a description which follows, and in part will become apparent to those skilled in the art upon examination of the following, or may be learned from practice of the invention. The instant invention will now be described with particular reference to the accompanying drawings.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 1:
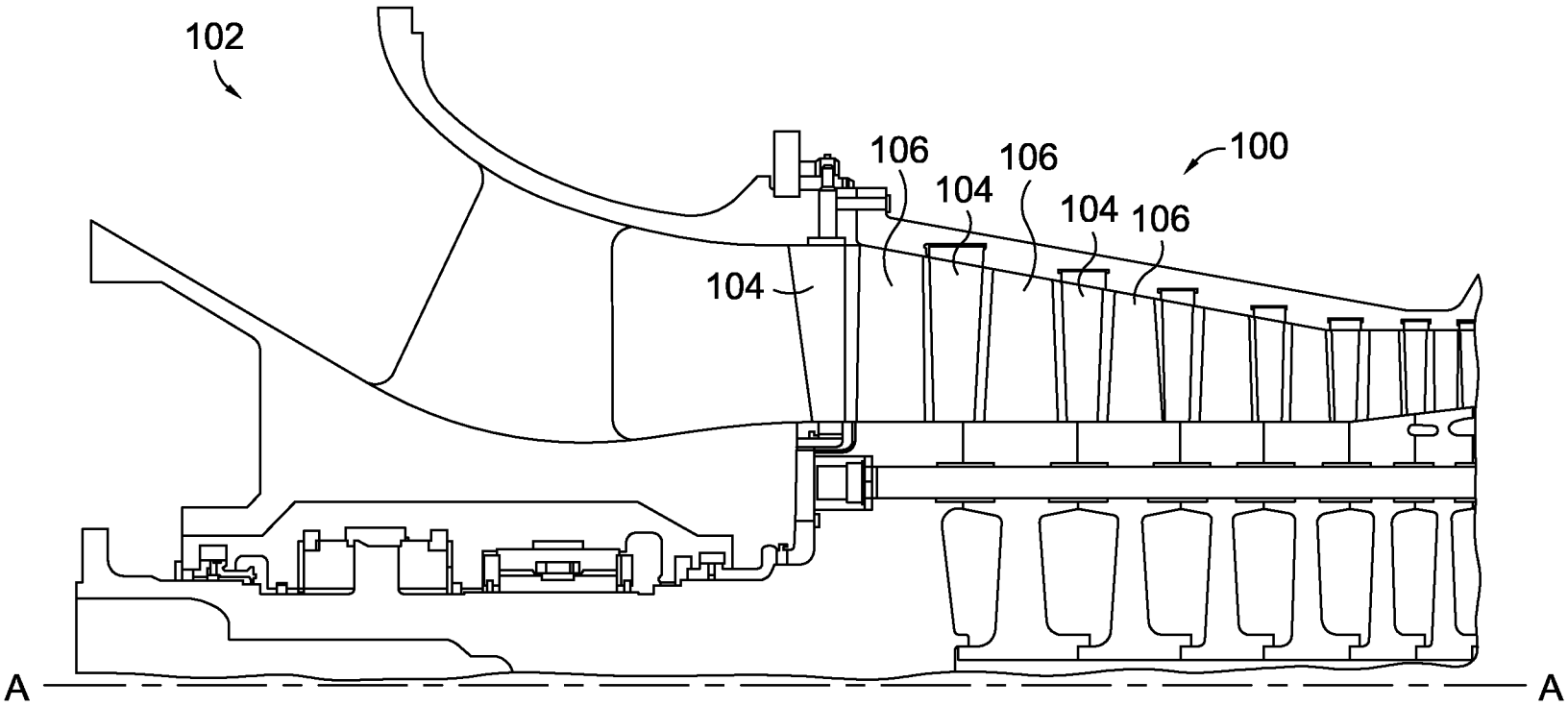
FIG. 1 is a cross section view of a portion of an axial compressor in which the present invention is capable of operating.

Referring initially to FIG. 1, a portion of an axial compressor 100 is shown in cross section. The engine in which the compressor 100 operates includes a centerline axis A-A about which the compressor blades and turbine blades rotate. As discussed above, a gas turbine engine draws air into compressor 100 through an inlet 102 and the air passes through a plurality of stages of stationary vanes 104 and rotating blades 106. The pressure and temperature of the air increases as the air is further compressed into a smaller volume as the air passes through the compressor and towards a combustion system (not shown).

Figure 4:
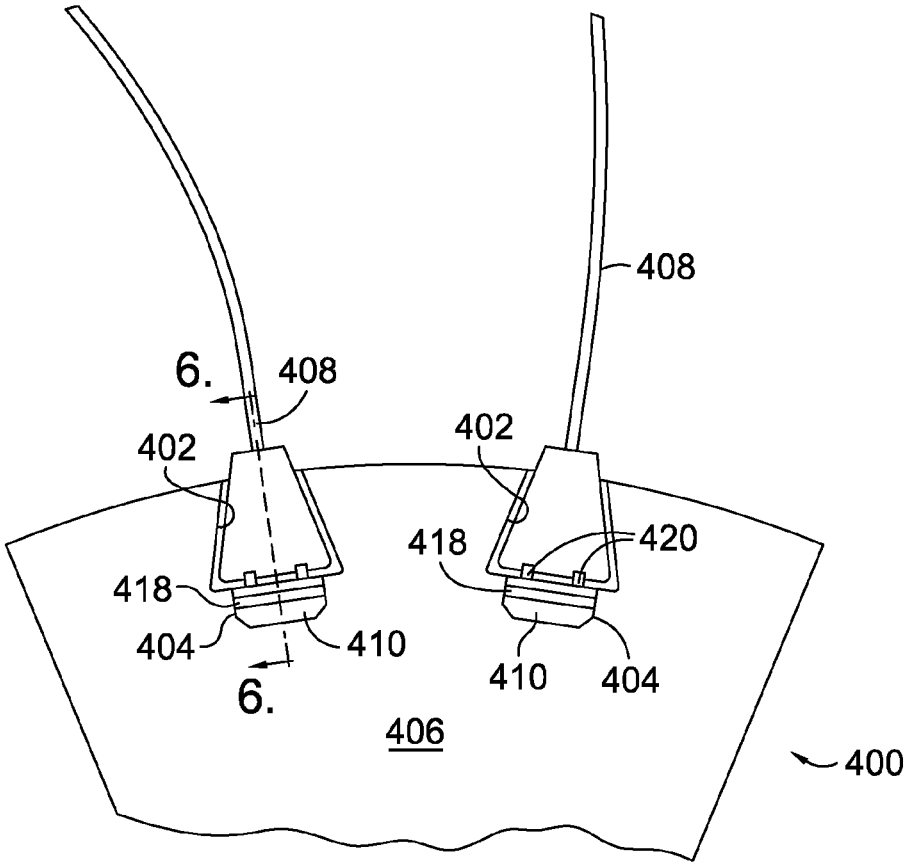
FIG. 4 is an end view of a portion of a rotor disk assembly in accordance with an embodiment of the present invention.
Figure 5:
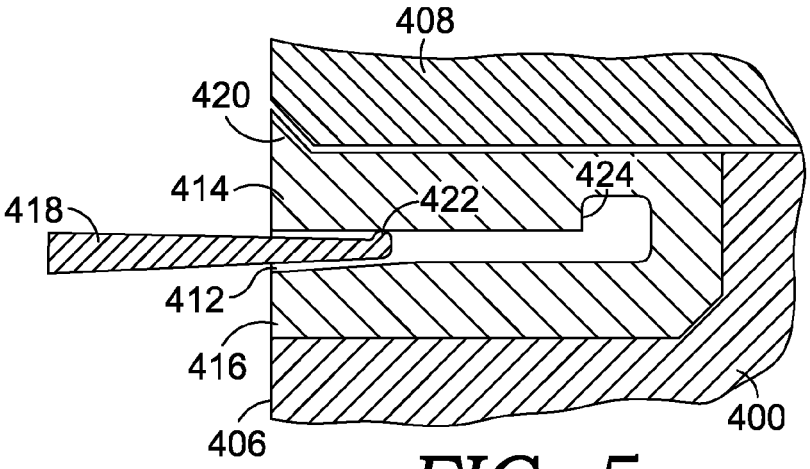
FIG. 5 is an exploded view taken in cross section depicting an embodiment of the present invention.
Figure 6:
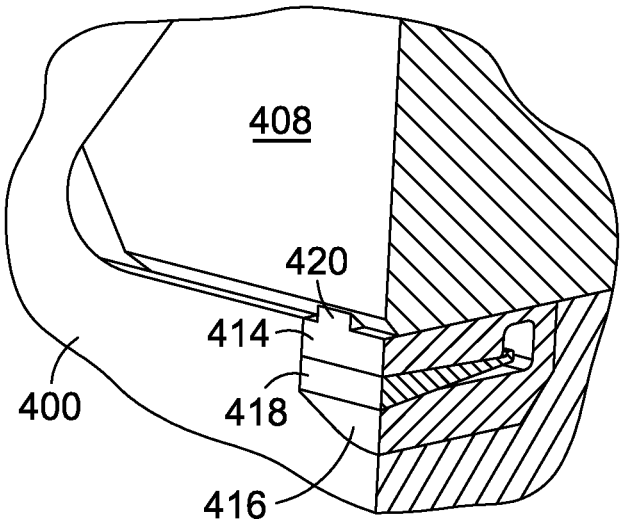
FIG. 6 is a perspective view taken in cross section depicting an embodiment of the present invention in which the blade is installed in the rotor disk.

Referring now to FIGS. 4-6, an embodiment of the present invention is depicted. Referring initially to FIG. 4, the present invention is shown in an end view. A portion of a rotating disk assembly is shown comprising a rotor disk 400, a plurality of slots 402 positioned about the circumference of rotor disk 400. Within each slot 402 is a retaining recess 404. The retaining recess 404 extends from a face 406 of the disk 400 a depth into the disk 400. Located within each slot 402 of the disk 400 is a blade 408. The rotating disk assembly also comprises a plurality of retaining inserts 410 positioned within each of the retaining recesses 404.

Figure 2:
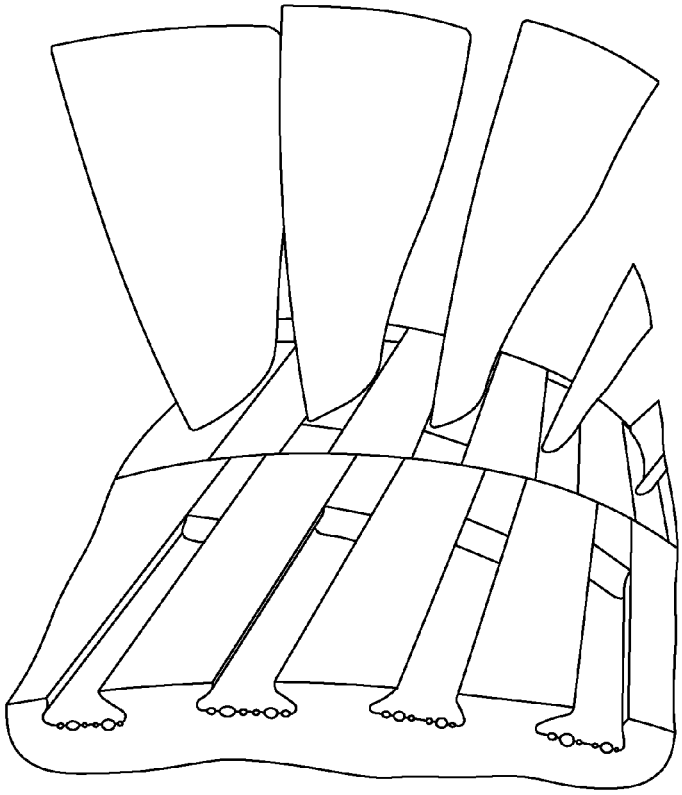
FIG. 2. PRIOR ART
FIG. 2 is a perspective view of a portion of a compressor utilizing a prior art means of securing the compressor blades to the rotor disk.
Figure 3:
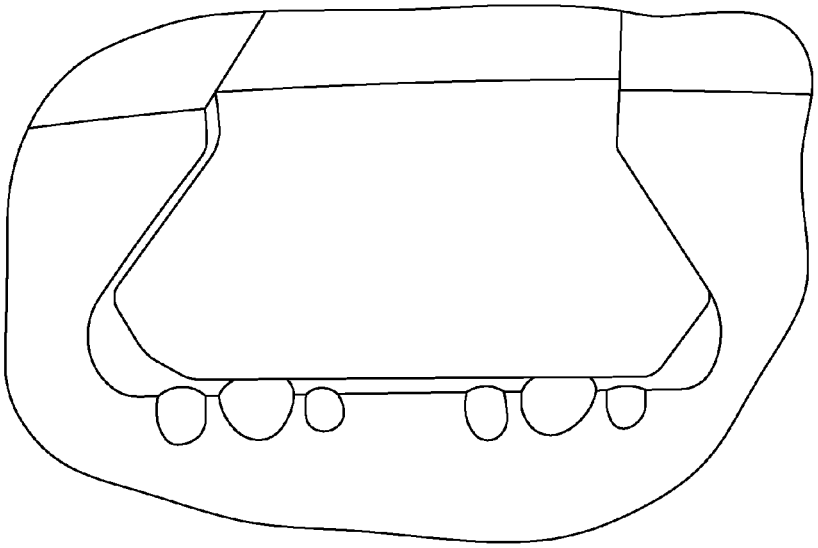
FIG. 3. PRIOR ART
FIG. 3 depicts an end view of a slot of the rotor disk in accordance with the prior art.

Referring now to FIGS. 5 and 6, each of the retaining inserts 410 also has a slot 412 located therein. The slot 412 divides the retaining insert 410 into an upper portion 414 and a lower portion 416. The slot 412 extends across an entire width of the retaining insert 410, as shown in FIG. 4. The rotor disk assembly also comprises a plurality of wedge inserts 418, where each wedge insert 418 is positioned within a slot 412. The wedge insert 418 is of generally triangular cross section, but this is only an exemplary wedge insert. As one of ordinary skill in the art understands, embodiments of the wedge insert 418 are not limited to the sides of the wedge being flat or parallel. Other embodiments of the wedge insert 418 can be utilized, including gradually curving faces of the wedge. The wedge insert 418 is positioned and sized such that when the wedge insert 418 is placed in the slot 412, the wedge insert 418 pushes the upper portion 414 of the retaining insert 410 radially outward and locks the upper portion 414 radially in position so that it contacts a portion of the attachment region of blade 408, as shown in FIG. 6. The wedge insert 418 has a locking feature 422, which engages locking step 424 and retains wedge insert 418 axially in position relative to retaining insert 410 after assembly. As discussed above, and depicted in FIGS. 2 and 3, one of the shortcomings of the prior art is the rolling or staking of disk material required to secure the blade in the disk slot. An additional shortcoming of the prior art is that the magnitude of deformation caused by the staking is highly variable depending on the skill of the installer. The present invention, as depicted in FIGS. 4-6 provides for a retaining mechanism to a blade 408 without deforming the rotor disk 400. The retaining insert 410 provides retention block 420 to secure the blade within the slot 402.

The retention block 420 extends from the upper portion 414 of the retaining insert 410. The retention block 420 is configured to contact a surface of the blade 408 so as to prevent axial movement of the blade 408 within the slot 402. In an embodiment of the invention, the retention block 420 has a generally triangular cross sectional shape. This is but one embodiment and the shape of the retention block 420 can vary depending on the size and shape of the blade attachment and slot in the disk. For example, the retention block 420 depicted in FIG. 6 does not extend the width of the retaining insert 410. The size of the retention block 420 could be increased so as to span the width of the retaining insert 410. When it is desired to remove the blade 408 from the slot 402 of the disk 400, the retention block 420 can be ground off so the blade 408 can be removed from the slot 402, or the wedge insert 418 can be removed from the slot 412 of the retaining insert 410.

The retaining insert 410 has a slot 412, as discussed above. For an embodiment of the present invention, the slot 412 has a keyhole cross sectional shape as shown in FIG. 5. The keyhole cross sectional shape allows for the upper portion 414 to flex and move relative to the lower portion 416 without creating a concentration of plastic strain that could result in a crack within the retaining insert 410. Because of the movement between the upper and lower portions, it is necessary for the end of the slot 412 to be rounded so that when the upper portion 414 moves relative to the lower portion any stresses at the end of the slot 412 are dissipated. The convex corner of the slot 412 forms a locking step 424. When the wedge insert 418 is fully inserted into slot 412, the wedge locking feature 422 engages the locking step 424 to prevent unintended removal of the wedge insert 418 from the slot 412.

The retaining insert 410 and wedge insert 418 can be fabricated from a steel alloy such as AISI 4340. This alloy is acceptable to use for fabricating the retaining insert 410 and wedge insert 418 because it provides excellent corrosion resistance properties and wear capability. The retaining inserts 410 are solution annealed while the wedge insert 418 is tempered to a high hardness. This allows the wedge insert 418 to maintain maximum elasticity so as to eliminate plastic deformation when the wedge is inserted into the retaining insert 410. This is but one embodiment of the materials that may be used for fabricating the retaining insert 410 and wedge insert 418.

While it is possible to apply a wear reduction coating to the surface of the slot 412 of the retaining insert 410 or the wedge insert 418, because of the hardening and solution annealing processes outlined above, the additional step of applying a coating is not believed to be necessary.

Figure 7:
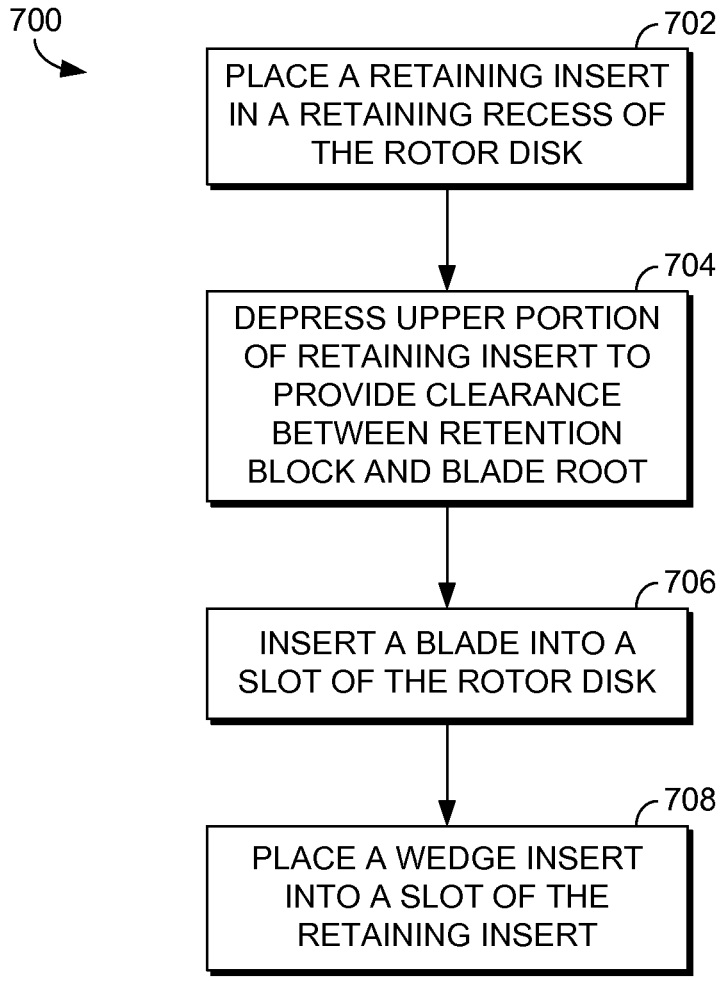
FIG. 7 is a flow chart identifying a method of securing a blade within a slot of a rotor disk.

Referring to FIG. 7, a method 700 is provided for retaining a blade within a rotor disk. In a step 702, a retaining insert 410 is placed within a retaining recess 404 of the rotor disk. Once the retaining recess is placed within the rotor recess 404, in a step 704, the upper portion 414 is depressed to provide clearance between the blade 408 and the retention block 420. Once the path of the blade 408 is clear, in a step 706, the blade 408 is inserted into the slot 402 of the rotor disk 400. Then, in a step 708, a wedge insert 418 is placed in the slot 412 of the retaining insert 410. The wedge insert, when placed in the slot of the retaining insert, applies a force to the upper portion 414 of the retaining insert and locks it radially in place, which either applies a force to the blade and/or places a retention block of the retaining insert into contact with the blade. The upper portion of the retaining insert bends upward due to a force applied by the wedge insert and generally returns to its designed position relative to the bottom of blade 408, as shown in FIG. 5.

The present invention can be applied to both newly manufactured disks and blades as well as part of an overhaul to existing hardware. For incorporation as part an overhaul, disk material within the slot 402 can be removed to form the recess 404.

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A rotating disk assembly comprising:

a rotor disk;

a plurality of slots positioned about the rotor disk, where each slot has a retaining recess;

a plurality of blades positioned within the slots of the rotor disk;

a plurality of retaining inserts positioned within each of the retaining recesses, each retaining insert having a slot located therein, wherein each retaining insert slot divides the retaining insert into an upper portion and a lower portion; and a plurality of wedge inserts positioned within each of the slots of the retaining inserts, wherein when each wedge insert is positioned in the retaining slot, the upper and lower portions are on opposite sides of the wedge insert, and the wedge insert pushes the upper portion radially outward to apply a force to the blade.

2. The rotating disk assembly of claim 1, wherein the retaining recess extends from a face of the rotor disk a distance into the rotor disk.

3. The rotating assembly of claim 1, wherein the retaining insert does not deform the blade or the rotor disk.

4. The rotating assembly of claim 1 further comprising a retention block extending from the upper portion of the retaining insert.

5. The rotor assembly of claim 4, wherein upon insertion of the wedge insert in the retaining insert, the retention block contacts the blade due to a bending of the retaining insert caused by the wedge insert.

6. The rotor assembly of claim 5, wherein the retaining insert provides an axial stop to secure the blade within the slot in the rotor disk.

7. The rotor assembly of claim 5, wherein the wedge insert includes a locking feature which prevents the removal of the wedge insert from the retaining insert.

8. The rotor assembly of claim 1, wherein the slot of the retaining insert includes a keyhole cross-sectional shape.

9. The rotor assembly of claim 1, wherein the slot of the retaining insert includes a locking step to prevent the removal of the wedge insert from the retaining insert.

10. The rotor assembly of claim 1, wherein a blade can be removed from the rotor disk upon removal of the retention block.

11. The rotor assembly of claim 1, wherein a blade can be removed from the rotor disk upon removal of the wedge insert and retaining insert.

12. A retaining mechanism for securing a blade to a rotor disk comprising:

a retaining recess positioned within the rotor disk, the recess extending from a face of the rotor disk a distance into a thickness of the rotor disk;

a retaining insert sized to fit in the retaining recess and having a slot extending therethrough, wherein the slot divides the retaining insert into an upper portion and a lower portion; and a wedge insert having a first thickness at a first end and a second thickness at a second end where the wedge insert tapers from the first thickness to the second thickness, wherein upon placement of the wedge insert into the slot of the retaining insert, the upper and lower portions of the retaining insert are on opposite sides of the wedge insert, and the upper portion of the retaining insert is pushed radially outward and against a blade attachment.

13. The retaining mechanism of claim 12, wherein the slot of the retaining insert includes a locking step to prevent the removal of the wedge insert from the retaining insert.

14. The retaining mechanism of claim 13 further comprising a retention block extending from the upper portion of the retaining insert.

15. The retaining mechanism of claim 12, wherein the slot in the retaining insert has a keyhole cross-sectional shape.

16. The retaining mechanism of claim 12, wherein the wedge insert is positioned within the slot of the retaining insert up to approximately a generally rounded end of the keyhole slot.

17. The retaining mechanism of claim 12, wherein the retaining insert is fabricated from a steel alloy.

18. The retaining mechanism of claim 12, wherein the wedge insert is fabricated from a steel alloy.

19. A method of retaining a blade within a rotor disk comprising:

placing a retaining insert in a retaining recess of the disk;

inserting a blade into a slot of the rotor disk; and placing a wedge insert into a slot of the retaining insert, wherein the retaining insert slot divides the retaining insert into an upper portion and a lower portion, and wherein when the wedge insert is positioned in the retaining slot, the upper and lower portions are on opposite sides of the wedge insert, such that the wedge insert applies a force to the upper portion of the retaining insert, thereby also placing a retention block of the retaining insert into contact with the blade.

20. The method of claim 19, wherein the slot of the retaining insert extends through a width of the retaining insert.

21. The method of claim 19, wherein the wedge insert is placed within the slot of the retaining insert so as to apply a force to the blade without deforming the blade or the disk.

22. The method of claim 19, wherein the wedge insert is placed within the slot of the retaining insert up to approximately a keyhole end of the slot.

23. The method of claim 19, wherein the blade being retained by the retaining insert and wedge insert is a compressor blade.

* * * * *